US006532292B1

(12) United States Patent
Lygas

(10) Patent No.: US 6,532,292 B1
(45) Date of Patent: Mar. 11, 2003

(54) METHOD AND APPARATUS TO TRANSMIT AUDIO INTO THE HUMAN EAR

(75) Inventor: Edward A. Lygas, San Marcos, CA (US)

(73) Assignees: Sony Corporation, Tokyo (JP); Sony Electronics, Inc., Park Ridge, NJ (US)

( * ) Notice: Subject to any disclaimer, the term of this patent is extended or adjusted under 35 U.S.C. 154(b) by 0 days.

(21) Appl. No.: 09/261,243

(22) Filed: Mar. 3, 1999

(51) Int. Cl.[7] ..... H04R 1/10; H04R 25/00

(52) U.S. Cl. ..... 381/74; 381/328; 381/380; 381/190; 181/130

(58) Field of Search ..... 381/309, 26, 312, 381/328, 329, 71.6, 72, 74, 111, 370, 380, 382, 151, 190, 191; 181/129, 130

(56) References Cited

U.S. PATENT DOCUMENTS 3,470,328 A * 9/1969 Daniels ..... 381/328
4,972,492 A * 11/1990 Tanaka et al. ..... 381/380
5,125,032 A * 6/1992 Meister et al. ..... 381/74
5,134,659 A * 7/1992 Moseley ..... 381/72
5,333,206 A * 7/1994 Koss ..... 381/380
5,448,637 A * 9/1995 Yamaguchi et al. ..... 381/328
5,631,965 A * 5/1997 Chang et al. ..... 381/74
5,691,515 A * 11/1997 Landis ..... 181/129
6,337,915 B1 * 1/2002 Lewis ..... 381/380

FOREIGN PATENT DOCUMENTS

JP 4-278798 * 10/1992 ..... 381/190

* cited by examiner

*Primary Examiner*—Xu Mei
(74) *Attorney, Agent, or Firm*—Frommer Lawrence & Haug LLP; William S. Frommer; Gordon Kessler

(57) ABSTRACT

Apparatus and method for generating an audio signal, comprising a first cylindrical electrode adapted to generate a first acoustic field and a first frequency generator coupled therewith. A second cylindrical electrode is positioned coaxially to the first cylindrical electrode and is adapted to generate a second acoustic field. An audio mixer drives the second cylindrical electrode with a modulated difference signal between a signal received from the first frequency generator and an input audio signal. The first and second acoustic fields exhibit an overlapping portion which generates an audible audio signal.

34 Claims, 2 Drawing Sheets

METHOD AND APPARATUS TO TRANSMIT AUDIO INTO THE HUMAN EAR

BACKGROUND OF THE INVENTION

This invention relates generally to a method and apparatus for providing an audio signal to a listener, and more particularly to a method and apparatus for generating an audio signal within the ear canal of a listener so that the listener may receive the audio signal without the audio signal causing any crosstalk or echoing problems with a related microphone, and for ensuring that the audio signal is not heard by anyone other than the intended listener.

In recent years, the use of cellular phones, and other small headset receiver/microphone units has increased. When receiving an audio signal from a speaker thereof positioned outside a listener's ear, an audio signal is generated in the speaker and directed towards the listener's ear. However, if this generated audio signal is played at a level sufficient to allow a listener to hear it, an echo or crosstalk at an associated transmitter microphone may result since the generated audio signal can be received by the transmit microphone, and be inadvertently transmitted thereby back to the source.

In an attempt to eliminate, or at least reduce this echo problem, prior art apparatuses have reduced to a minimum a transmit gain for the microphone while the headset speaker is generating the audio signal by way of complicated digital signal processing schemes. Other attempts at eliminating or reducing this echo problem have included controlling the geometries and positions of the microphone and the speaker relative to each other. However, because a speaker in such a headset is driven to produce a sound pattern whose direction is not easily controlled, these attempts at reducing echo and crosstalk have been less than satisfactory.

Therefore, it would be beneficial to provide an apparatus including a speaker/earpiece and microphone which allow a user to hear information and retransmit information, respectively, while reducing the echo and crosstalk therebetween to an acceptable level.

OBJECTS OF THE INVENTION

Accordingly, it is an object of the invention to provide an improved method and apparatus for receiving and reproducing an audio signal.

Another object of the invention is to provide an improved method and apparatus for allowing a user to hear an audio signal received via a wireless transmission and reducing the amount of echo and crosstalk produced in an associated microphone.

A further object of the invention is to provide an improved method and apparatus for providing an audio signal to a listener which reduces the possibility of the audio signal being listened to by anyone other than the intended listener.

Still another object of the invention is to provide an improved method and apparatus for generating an audio signal in a listener's ear canal, thereby reducing echo, and ensuring privacy of the audio signal.

Still other objects and advantages of the invention will in part be obvious and will in part be apparent from the specification and drawings.

SUMMARY OF THE INVENTION

Generally speaking, in accordance with the invention, an improved method and apparatus for providing an audio signal to a listener is provided. An audio signal is provided to a user via an earpiece which generates this audio signal within the ear canal of the listener. The audio signal is generated using a concentric transducer scheme to generate different ultrasonic waveforms focused within the listener's ear canal. The concentric ultrasonic beams are directed into the ear canal where the nature of the ear detects the audible modulation between the concentric ultrasonic beams. One of the transducers is designed as part of a stable oscillator and feeds a sample of its signal to a circuit that modulates this oscillation by an audio information signal and provides only the lower difference-frequency signal thereof to a transducer driver. This transducer driver then powers the second transducer of the concentric transducer pair to generate the modulation noted above. The audio information signal may be provided to the earpiece via a wire from an external receiver unit, or alternatively, from an internally based receiver unit.

Therefore, in accordance with the invention, the audio signal is generated within the ear canal of a listener, thereby reducing echo and crosstalk between the generated audio signal, and any signal being transmitted through an associated microphone, and further ensures the security of the audio signal listened to by the user.

The invention accordingly comprises the several steps and the relation of one or more of such steps with respect to each of the others, and the apparatus embodying features of construction, combinations of elements and arrangement of parts which are adopted to effect such steps, all as exemplified in the following detailed disclosure, and the scope of the invention will be indicated in the claims.

BRIEF DESCRIPTION OF THE DRAWINGS

For a more complete understanding of the invention, reference is made to the following description and accompanying drawings, in which.

DETAILED DESCRIPTION OF THE PREFERRED EMBODIMENTS

Figure 1:
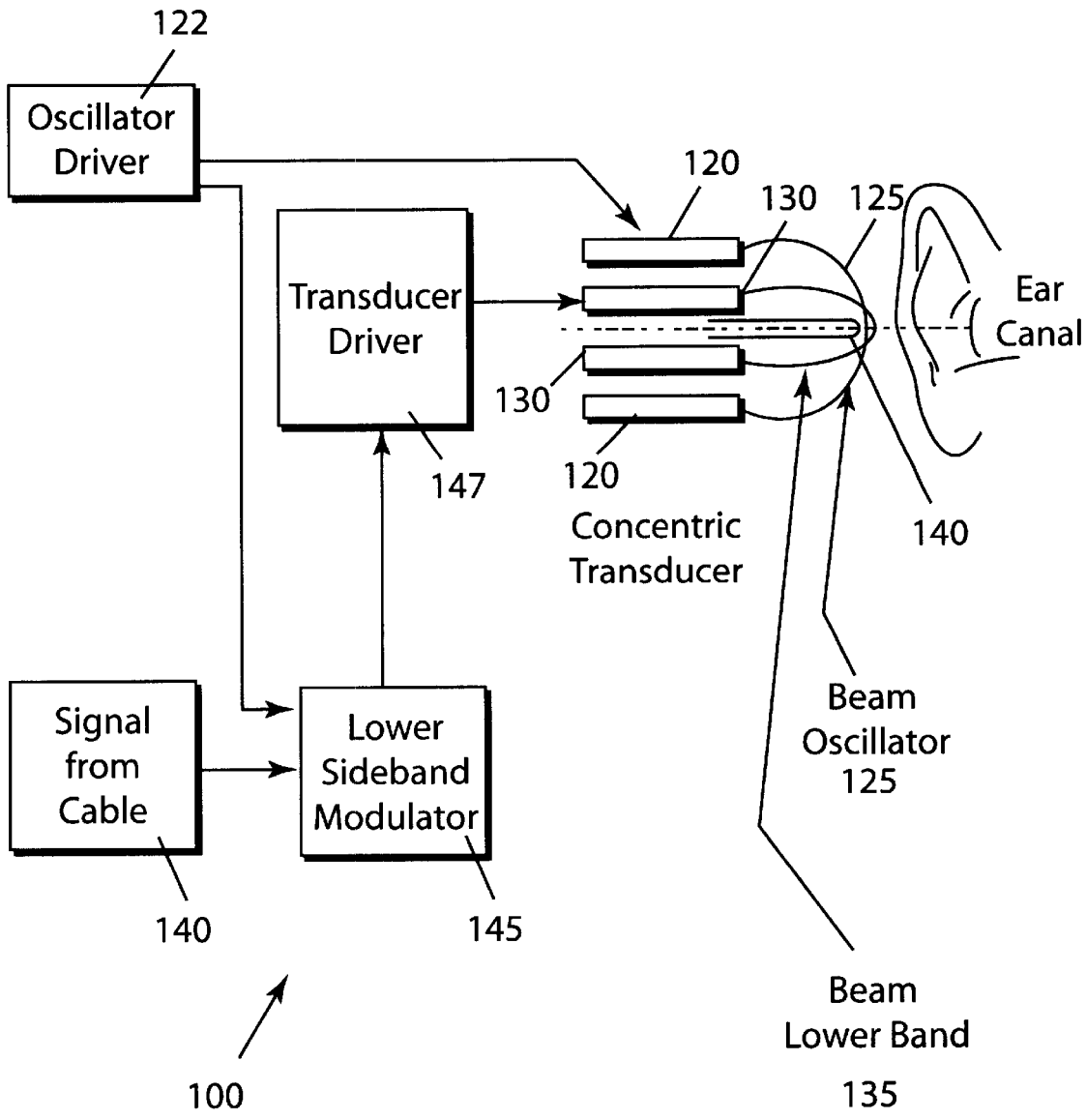
FIG. 1 is a schematic view depicting the structure of generated beam patterns of an apparatus constructed in accordance with the invention, and the relation of these beam patterns to a listener's ear.

Referring first to FIG. 1, an audio signal generator is depicted, indicated generally at 100. Audio signal generator 100 is formed of first and second concentric cylindrical elements 120 and 130. Each of concentric elements 120 and 130 is preferably formed of a piezoelectric material, and is shaped into a cylinder or alternatively into a ring. In an alternative embodiment, each concentric cylindrical element 120 or 130 may be formed as an array of piezoelectric elements. When first concentric element 120 is electrically driven, the first concentric element generates an acoustic field 125. This field is shaped in accordance with the diameter of the first concentric element. The field 125 is generated at a frequency corresponding to the driving frequency of the first concentric element. This driving frequency is provided by oscillator driver 122, and is provided at a constant, predetermined frequency.

Similarly, when second concentric element 130 is electrically driven, acoustic field 135 is generated. This field is shaped according to the diameter of the second concentric element. The frequency of the field is determined in accordance with the driving frequency of the second concentric element. An audio information signal 160 is received from an external source, such as via a cable or wireless transmitter, by way of example, and this audio information signal is provided to a lower side band modulator 145 along with the output oscillator signal from oscillator driver 122. The oscillator signal received from oscillator driver 122 is modulated in accordance with the audio signal contained within audio information signal 160, and the resultant difference-frequency signal, that is, the lower side band of the modulated signal, is filtered and output from lower side band modulator 145 to transducer driver 147. Transducer driver 147 in turn drives second concentric element 130 in accordance with this lower difference-frequency signal.

Concentric elements 120 and 130 are provided within an earpiece which is maintained adjacent the listener's ear, and which may be maintained in this position via a headset, or other mechanism, such as a hook for clipping onto the listener's ear or the like. While concentric elements 120 and 130 in FIG. 1 are shown so that acoustic fields 125 and 135 are positioned outside the listener's ear canal, this is for illustrative purposes only. In actual operation, the concentric elements would be positioned closer to the listener's ear, and fields 125 and 135 would be positioned within the listener's ear canal, in accordance with the invention. The concentric elements are positioned so that fields 125 and 135 extend substantially parallel to the listener's ear canal, and into the interior thereof.

As can be seen in FIG. 1, fields 125 and 135 overlap. Since first concentric element 120 and second concentric element 130 are driven at different frequencies, namely, the oscillator frequency from oscillator driver 121, and the lower difference-frequency provided by lower side band modulator 145, respectively, fields 125 and 135 will also be operating at different frequencies. Therefore, an area 140 of high intensity is generated in an area of overlap between the two fields in the presence of air or in any other non-linear medium, in accordance with the invention. This high intensity area provides a difference frequency in accordance with the difference between the frequency of fields 125 and 135 only on the axis concentric to the concentric elements.

Because air contained within the listener's ear canal is a non-linear substance, the difference frequency of high intensity area 140 produces an audible sound within the listener's ear canal if the frequencies of fields 125, and 135 are properly chosen. Such frequencies may be in the range of, by way of example, 100 Hz to 15 kHz, and more preferably in the range of 300 Hz to 3500 Hz. This audio signal which is generated in the listener's ear canal can be heard by the listener. Since the audio signal is actually generated within the ear canal of the listener, there is little or no possibility that this generated signal will be heard by anyone other than the intended listener, since no sound is provided outside the listener's ear canal. This feature also aids in reducing echo and crosstalk from a transmission microphone which may pick up such audio signal, and re-transmit the information back to the sender.

The illustrated apparatus will operate up to a predetermined distance from a listener's ear canal, as long as the area 140 overlaps with this ear canal. By using cylindrical elements 120 and 130 having a longer coaxial distance, or other characteristics such as a greater diameter, a longer field can be generated, and therefore a longer audio detection distance can also be generated, thus accommodating larger earpieces which may position the concentric elements further from the listener's ear canal. Therefore, it is possible to provide an audio signal generating system which provides a directional audio signal positioned within the listener's ear canal, thereby protecting the security thereof, and the operation of any received/transmission systems which might be adversely affected by a stray audio signal. While sidelobes of each field 125 and 135 may be produced, an audible signal will only be generated when these sidelobes are aligned, which can be avoided by design choice.

Figure 2:
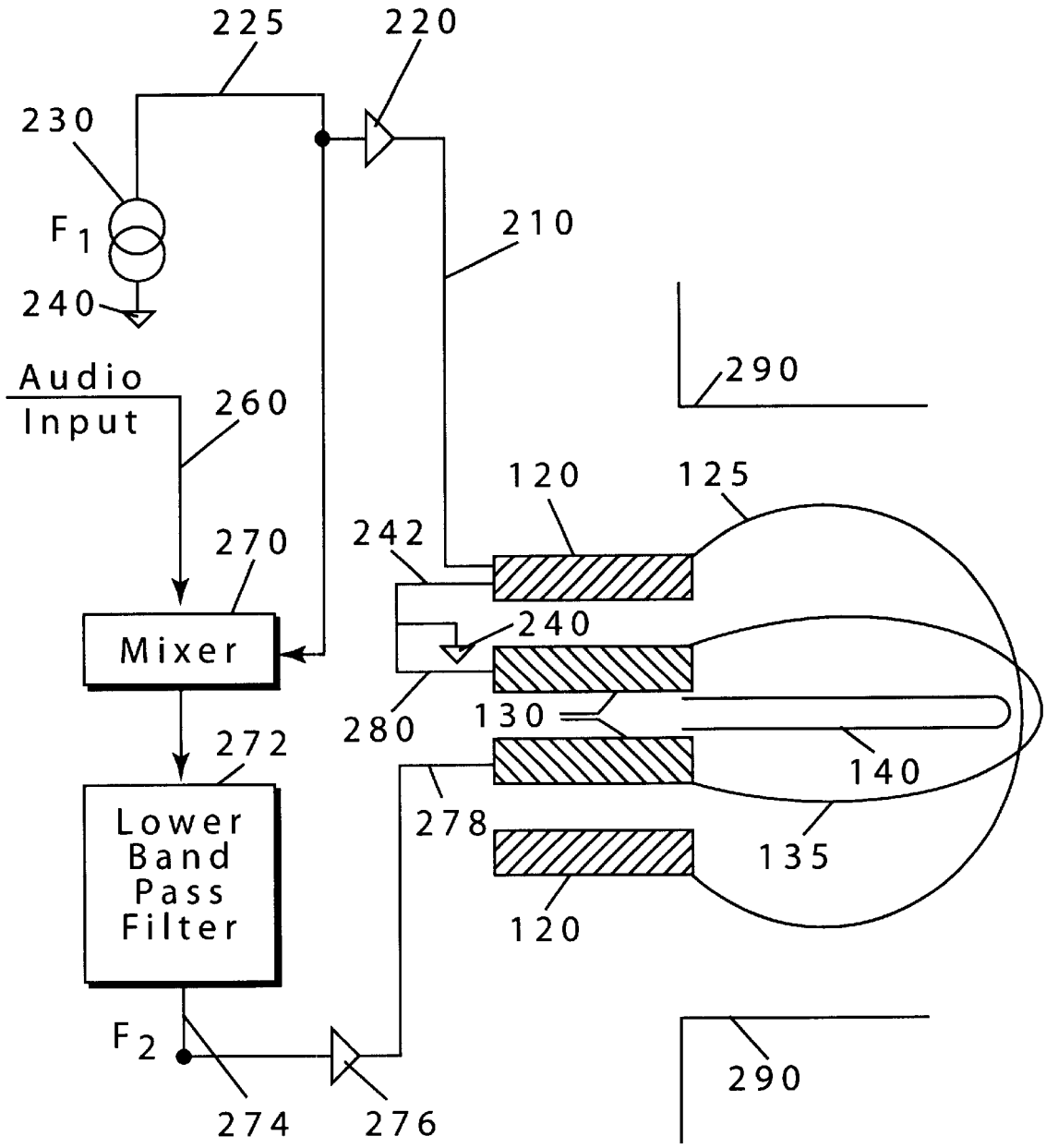
FIG. 2 is a schematic drawing depicting an audio signal generation apparatus constructed in accordance with the invention.

Referring next to FIG. 2, an audio signal generator is depicted, and is indicated generally at 200. As is shown in FIG. 2, concentric elements 120 and 130 generating fields 125 and 135, respectively, are provided, resulting in high intensity area 140. First concentric element 120 is driven by a frequency generator 230 generating a frequency $F_1$. One terminal of frequency generator 230 is connected to ground 240 and the other terminal supplies frequency $F_1$ via line 225 to a tuned amplifier 220 and also to an audio mixer 270. The amplified signal of frequency $F_1$ produced by tuned amplifier 220 is coupled by a line 210 to drive first concentric element 120. Concentric element 120 is also connected to ground 240 via a line 242.

The signal of frequency $F_1$ passed to mixer 270 is modulated by an audio input 260 also provided to mixer 270. In a preferred embodiment, audio input 260 is in the range of from between 300 Hz to 3500 Hz. The input frequency of audio input 260 can be on the order of from 100 Hz to 15 kHz in an alternative embodiment.

The modulated output from mixer 270 is forwarded to a lower band pass filter 272 to remove any high frequency components of the modulation, and to provide only the lower difference-frequency signal as an output. The output from the lower band pass filter at a frequency $F_2$ is forwarded via a line 274 to a tuned amplifier 276. The amplified signal of frequency $F_2$ produced by tuned amplifier 276 is coupled by a line 278 to drive second concentric element 130 at frequency $F_2$.

In accordance with the invention, first and second concentric elements 120 and 130 of audio signal generator 200 are respectively driven at frequencies $F_1$ and $F_2$. Frequencies $F_1$ and $F_2$ differ by a predetermined amount in order to provide the audible signal generated within high intensity region 140. The driving units, frequency generator 230 and the output from low band pass filter 272 noted above, for concentric elements 120 and 130 are of the switched type, and feed a tuned series circuit which may be tuned by the adjustment of frequency generator 230, and audio input 260. Additionally, frequency generator 230 may be digitally controlled, and current limited to ensure the accuracy and safety of the apparatus.

As is further shown in FIG. 2, audio signal generator 200 is positioned adjacent a listener's ear, so that at least high intensity portion 140 is generated within the listener's ear canal 290. The received audio input 260 is used to generate the audio signal within the listener's ear canal. This audio input 260 is modulated with stable frequency $F_1$ provided from frequency generator 230 as noted above. The side bands produced by mixer 270 are low band pass filtered by low band pass filter 272 to supply the difference-frequency signal $(F_1-F_2)$ to drive second concentric element 130. Thereafter, as noted above with respect to FIG. 1, an interference pattern between fields 125 and 135 is produced with the modulated frequency $F_1-(F_1-F_2)$ in a high intensity region 140. As is further shown in FIG. 2, this high intensity region 140 and thus the resulting audio signal, is generated within the listener's ear canal 290. Since the audio signal is not generated at a speaker outside the listener's ear, as in a conventional earpiece, the audio signal will not be heard by anyone other than the intended listener, and can not be picked up by any adjacent microphone which might be used by the listener to retransmit information, such as in a telephone device.

Since the audio signal is only generated within the listener's ear canal, there is little or no chance that anyone other than the intended listener will be able to hear the audio signal. Furthermore, and in addition to not allowing others to hear the audio signal, this audio signal will not be provided to any attached microphone, or interfere with any additional electronic equipment used by the user. Thus, superior playback, and two-way communication utilizing an associated earpiece constructed in accordance with the invention, and a conventional microphone can be provided.

The apparatus constructed in accordance with the invention has many uses, including as a wireless, or wired, receiver having an earpiece speaker and associated retransmitting microphone. The earpiece constructed in accordance with the invention may also be provided with a cellular, or other portable telephone, and thus eliminates the need in the cellular phone to provide a digital signal processor (DSP) for removing echo and signal coupling which typically occurs when the earpiece and microphone are positioned close to each other. Because the audio signal is generated within the listener's ear canal, there is no echo or signal coupling.

The earpiece constructed in accordance with the invention may also be utilized as a stand alone earpiece providing superior sound as compared with conventional earpieces, while ensuring that the audio signal is not heard by others, which is typically the case with conventional head phones used to play music, such as those used in connection with portable CD players, tape players, mini-disc players, radios or the like.

Also, an earpiece constructed in accordance with the invention may be utilized as a hearing aid, with the received audio signal being provided via a portable receiver within the earpiece unit, or alternatively, the earpiece may be constructed with a coupling coil to interface with existing hearing aids to comply with released or proposed federal regulations. The concentric elements would be provided with a magnetic link to couple audio signals into the hearing aid, bypassing the normal audio pickup function of the hearing aid. Of course, the remainder of the apparatus operates as noted above with respect to FIG. 2. As a result, an improved hearing aid is provided because the audio signal may be generated within the listener's ear canal, closer to the listener's ear drum. Also, since a greater portion of the apparatus is provided within the listener's ear canal, a less obtrusive, and therefore less noticeable hearing aid product is obtained.

Numerous other uses for an earpiece constructed in accordance with the invention may be provided, and these may be utilized in any situation where the generation of an audio signal within a listener's ear canal would be beneficial.

It will thus be seen that the objects set forth above, among those made apparent from the preceding description, are efficiently attained and, since certain changes may be made in carrying out the above method and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and statements of the scope of the invention which, as a matter of language, might be said to fall therebetween.

What is claimed:

1. An apparatus for generating an audio signal, comprising:

a first cylindrical element adapted to generate a first acoustic field;

a first frequency generator coupled to said first cylindrical element for generating a stable frequency signal;

a second cylindrical element positioned concentrically to said first cylindrical element and adapted to generate a second acoustic field;

an input for supplying an audio frequency signal having an audio frequency; and an audio mixer coupled to said second cylindrical element, said audio mixer receiving said audio frequency and stable frequency signals for providing a modulated difference signal therebetween such that said first and second acoustic fields exhibit an overlapping portion having said audio frequency, thereby generating an audible audio signal.

2. The apparatus of claim 1, wherein said overlapping portion is positioned within a listener's ear canal.

3. The apparatus of claim 1, wherein said first and second cylindrical elements are positioned within an earpiece.

4. The apparatus of claim 1, wherein said input supplies said audio frequency signal to said mixer via wireless communication.

5. The apparatus of claim 1, wherein said input supplies said audio frequency signal to said mixer via a wired input.

6. The apparatus of claim 1, further including a lower band pass filter coupled to receive an output signal from said mixer to supply a lower difference-frequency between said audio frequency and said stable frequency to drive said second cylindrical element.

7. The apparatus of claim 1, wherein said overlapping portion generates a frequency from between 300 to 3500 Hz.

8. The apparatus of claim 1, wherein said overlapping portion generates a frequency of from between 100 Hz to 15 KHz.

9. The apparatus of claim 1, wherein at least said first and second cylindrical elements are disposed within an earpiece of a cellular telephone.

10. The apparatus of claim 1, wherein at least said first and second cylindrical elements are disposed within a hearing aid.

11. The apparatus of claim 1, wherein said apparatus is coupled with a standard hearing aid.

12. The apparatus of claim 11, wherein said first and second cylindrical elements are provided with a magnetic link to couple audio signals into the hearing aid, bypassing the normal audio pick-up function of the hearing aid.

13. The apparatus of claim 1, wherein at least said first and second cylindrical elements are disposed within an audio headphone device.

14. The apparatus of claim 1, wherein said overlapping portion is substantially unidirectional and is directed into a listener's ear canal.

15. The apparatus of claim 1, wherein said overlapping portion is maintained within a listener's ear canal, and said audible audio signal is inaudible outside the listener's ear canal.

16. The apparatus of claim 13, wherein said generated audible audio signal does not interfere with an associated microphone.

17. The apparatus of claim 1, wherein each of said first and second cylindrical elements are formed of an array of elements.

18. A method for generating an audio signal, comprising the steps of:

driving a first cylindrical element with a stable frequency signal to generate a first acoustic field;

inputting an input audio signal of an audio frequency;

generating a modulated difference signal between said stable frequency signal and said input audio signal;

generating a second acoustic field, in response to said modulated difference signal, from a second cylindrical element positioned concentrically to said first cylindrical electrode, wherein said first and second acoustic fields exhibit an overlapping portion; and generating an audible audio signal from said overlapping portion.

19. The method of claim 18, wherein said overlapping portion is positioned within a listener's ear canal.

20. The method of claim 18, wherein said first and second cylindrical elements are positioned within an earpiece.

21. The method of claim 18, wherein said input audio signal is supplied via wireless communication.

22. The method of claim 18, wherein said input audio signal is supplied via a wired input.

23. The method of claim 18, wherein said modulated difference signal is a lower difference-frequency signal.

24. The method of claim 18, wherein said overlapping portion generates a frequency from between 300 to 3500 Hz.

25. The method of claim 18, wherein said overlapping portion generates a frequency of from between 100 Hz to 15 KHz.

26. The method of claim 18, wherein at least said first and second cylindrical elements are disposed within an earpiece of a cellular telephone.

27. The method of claim 18, wherein at least said first and second cylindrical elements are disposed within a hearing aid.

28. The method of claim 18, wherein said first and second cylindrical elements are coupled with a standard hearing aid.

29. The method of claim 28, wherein said first and second cylindrical elements are provided with a magnetic link to couple audio signals into the hearing aid, bypassing the normal audio pick-up function of the hearing aid.

30. The method of claim 18, wherein at least said first and second cylindrical elements are disposed within an audio headphone device.

31. The method of claim 18, wherein said overlapping portion is substantially unidirectional and is directed into a listener's ear canal.

32. The method of claim 18, wherein said overlapping portion is maintained within a listener's ear canal, and said audible audio signal is inaudible outside the listener's ear canal.

33. The method of claim 18, wherein said generated audible audio signal does not interfere with an associated microphone.

34. The method of claim 18, further comprising the step of forming said first and second cylindrical elements of an array of elements.

* * * * *